US007810520B2

(12) United States Patent
Perratone et al.

(10) Patent No.: US 7,810,520 B2
(45) Date of Patent: Oct. 12, 2010

(54) CONNECTOR FOR ARTICULATED HYDROCARBON FLUID TRANSFER ARM

(75) Inventors: Renè Perratone, Menton (FR); Jean-Pierre Queau, Nice (FR)

(73) Assignee: Single Buoy Moorings Inc., Marly (CH)

( * ) Notice: Subject to any disclaimer, the term of this patent is extended or adjusted under 35 U.S.C. 154(b) by 22 days.

(21) Appl. No.: 10/555,693

(22) PCT Filed: May 4, 2004

(86) PCT No.: PCT/EP2004/004894

§ 371 (c)(1),
(2), (4) Date: Nov. 4, 2005

(87) PCT Pub. No.: WO2004/099062

PCT Pub. Date: Nov. 18, 2004

(65) Prior Publication Data

US 2007/0084514 A1 Apr. 19, 2007

(30) Foreign Application Priority Data

May 5, 2003 (EP) ..... 03076304

(51) Int. Cl.
*F15B 13/00* (2006.01)

(52) U.S. Cl. ..... 137/615; 414/137.9

(58) Field of Classification Search ..... 137/615; 414/137.9, 138.1, 138.2; 114/230.17
See application file for complete search history.

(56) References Cited

U.S. PATENT DOCUMENTS 2,450,895 A * 10/1948 Keim ..... 285/121.3
2,834,465 A * 5/1958 McMichael ..... 210/95

(Continued)

FOREIGN PATENT DOCUMENTS

EP 1 283 159 2/2003

(Continued)

OTHER PUBLICATIONS

IHC Caland, Annual report 2002,Mar. 26, 2003, pp. 1, 14 and 82.*

*Primary Examiner*—John Rivell
*Assistant Examiner*—Craig Price
(74) *Attorney, Agent, or Firm*—Young & Thompson

(57) ABSTRACT

A hydrocarbon transfer system includes a first structure carrying an articulated arm, having at a free end a first connector part, and a vessel having a second connector part, each connector part including a coupling member. The coupling member of the first connector part supporting at least one fluid duct on its exterior, which duct can be placed into sealing engagement with a fluid duct on the vessel along respective sealing faces, and a locking member for locking the coupling members together. The fluid duct on the vessel has a substantially horizontally directed first and second duct section. The first duct section is connected to piping on the vessel. The second duct section is connected to the fluid duct on the coupling member of the first connector part, the first and second duct sections being mutually connected.

6 Claims, 18 Drawing Sheets

U.S. PATENT DOCUMENTS

| | | | | | |
|---|---|---|---|---|---|
| 3,032,082 | A | * | 5/1962 | Vilain | 137/615 |
| 3,154,118 | A | * | 10/1964 | Silveston | 137/615 |
| 3,199,898 | A | * | 8/1965 | Faccou | 137/615 |
| 3,675,680 | A | * | 7/1972 | Frohlich et al. | 137/615 |
| 4,388,948 | A | | 6/1983 | Carminati et al. | |
| 4,393,906 | A | * | 7/1983 | Gill | 414/138.2 |
| 4,547,256 | A | | 10/1985 | Gurtler et al. | |
| 4,876,978 | A | * | 10/1989 | O'Nion et al. | 114/230.15 |
| 6,343,620 | B1 | * | 2/2002 | LeDevehat et al. | 137/615 |
| 7,174,930 | B2 | * | 2/2007 | Poldervaart et al. | 141/387 |

FOREIGN PATENT DOCUMENTS

| | | | |
|---|---|---|---|
| WO | WO03/013951 | * | 2/2003 |

* cited by examiner

CONNECTOR FOR ARTICULATED HYDROCARBON FLUID TRANSFER ARM

The invention relates to a hydrocarbon transfer system, comprising a first structure carrying an articulated arm having at the free end a first connector part, and a vessel comprising a second connector part for releasably interconnecting hydrocarbon fluid ducts on the structure and on the vessel.

U.S. Pat. No. 6,343,620 discloses a transfer device between a jib including at least one pipe section fixed to the jib and a coupling comprising a system of concertina or deformable diamond-shaped type articulated pipe segments. The known structure is relatively complex and cannot transmit any mooring forces to couple a vessel, such as an oil tanker, in a constant relative position with respect to a platform 10 carrying the crane.

From U.S. Pat. No. 5,363,789, in the name of the applicant, a connector system is known for connecting the risers on a submerged riser supporting buoy to the bottom of a turret of a weathervaning vessel. In the known mooring system, the mooring lines are attached to the riser supporting buoy, which is pulled via a cable running through the turret against the bottom of the turret. Upon coupling, the sealing faces of the risers can be withdrawn below the contact surface of the riser supporting buoy and the turret. Through hydraulic actuation, the moveable riser ends can be extended in the length direction of the risers after attaching the buoy to the turret to warrant a fluid tight coupling.

The known riser connecting system has as a disadvantage that the coupling system cannot be accessed easily for maintenance or repair purposes.

Furthermore, the known is system is not suitable for loading or offloading via an articulated arm to shore or to another offshore construction such as a platform or tower-supported construction.

It is an object of the present invention to provide a loading and offloading system of relatively simple design, which can be used for mooring a vessel to a structure and for loading and offloading hydrocarbon fluids such as oil, gas, compressed gas or LNG via the articulated arm.

It is a further object of the present invention to provide a loading and offloading system through which multiple fluid ducts, for instance supplying different fluids at different temperatures or pressures, can be simultaneously connected and disconnected in a rapid an reliable manner.

It is a particular object of the present invention to provide a LNG hydrocarbon transfer and mooring system.

It is again another object of the present invention to provide a transfer system in which the connector parts are easily accessible for maintenance and/or repair.

Thereto, the hydrocarbon system according to the present invention has a fluid duct on the vessel which comprises a substantially horizontally directed first and second duct section, the first duct section being via a first swivel with a substantially vertical axis of rotation, connected to piping on the vessel, the second duct section being via a second swivel having a substantially vertical axis of rotation, connected to the fluid duct on the coupling member of the first connector part, the first and second duct sections being mutually connected via a third swivel having a substantially vertical axis of rotation.

Upon mechanically connecting, the duct sections of the vessel can be rotated out of the area of the coupling members, the coupling area being an entire perimeter beneath the externally placed ducts of the arm extending to the deck, such that no interference of the externally placed ducts on the free end of the arm, and the piping on the deck occurs. After mechanical connection, the ducts on the vessel can be aligned with the ducts on the free end of the arm, and can be placed in sealing engagement, for instance by axial displacement of the sealing surfaces.

The externally placed duct sections on the free end of the arm allow easy access for maintenance and/or repair or exchange.

The connector parts according to the present invention are suitable for simultaneously connecting a number of fluid transfer ducts, which may have different diameters and which may supply fluids at different temperatures and pressures, such as LNG ducts and vapour return ducts, crude oil and gas, compressed gas, chemicals, water, etc.

Furthermore, the articulated mooring arm is able to take up mooring forces of the vessel, such that a separate mooring system of additional hawsers, or mooring chains is not required for stable positioning of the vessel relative to the structure, such as platform, tower, onshore loading and offloading terminals, production and storage vessels, and the like.

The arm structure carrying the transfer ducts whereas leakage free interconnection of the housing and/of the ducts along their sealing faces and forms a transfer system which is able to take-up mooring forces while at the same time safely and reliably transferring hydrocarbon fluids.

In one embodiment, a pulling member is attachable to a central part of the first and second connectors and extends through a central space of the housing of at least one of the connectors, the pulling member being connected to a take up device on the arm or on the vessel.

A first alignment of the connector parts is obtained by hauling in the pulling member, which may be a cable, wire rope or chain. The pulling member may be attached to a winch, which can be placed on the articulated arm. The pulling member extends through the central part of the first and second connectors.

For fine positioning of the connector part on the vessel and the free end of the arm, the housing of the connector parts comprises on each side of a centre line a flange, the second connector part comprising at least two retractable grippers for engaging with a respective flange and for placing the housings of the first and second connector with contact faces in mutual engagement.

The grippers operating on the housing of the connector part on the arm allow for accurate alignment and positioning of the connector part and engaging the contact faces of each connector part. The housing of the first connector part may comprise a circumferential rim whereas the second connector part comprises clamping means for engaging with the rim. The interconnection of the housing will transfer the mooring forces to a large extent whereas separate interconnection of fluid transfer ducts via the drive means for rotational alignment and the displacement of the ducts in the length directions, allows a fluid tight connection which is not subject to substantial forces. The second connector part on the vessel may comprise at the radial distance thereof a ring-shaped guiding member sloping downwards in the direction of the centre line of the connector. The ring-type fender construction prevents the connector part on the arm from impacting with the vessel and from consequent damage. The connector at the free end of the arm is guided along the ring-shaped guiding member to its approximate coupling position.

A number of embodiments of a transfer system according to the present invention will be described in detail with reference to the accompanying drawings. In the drawings.

Figure 13:
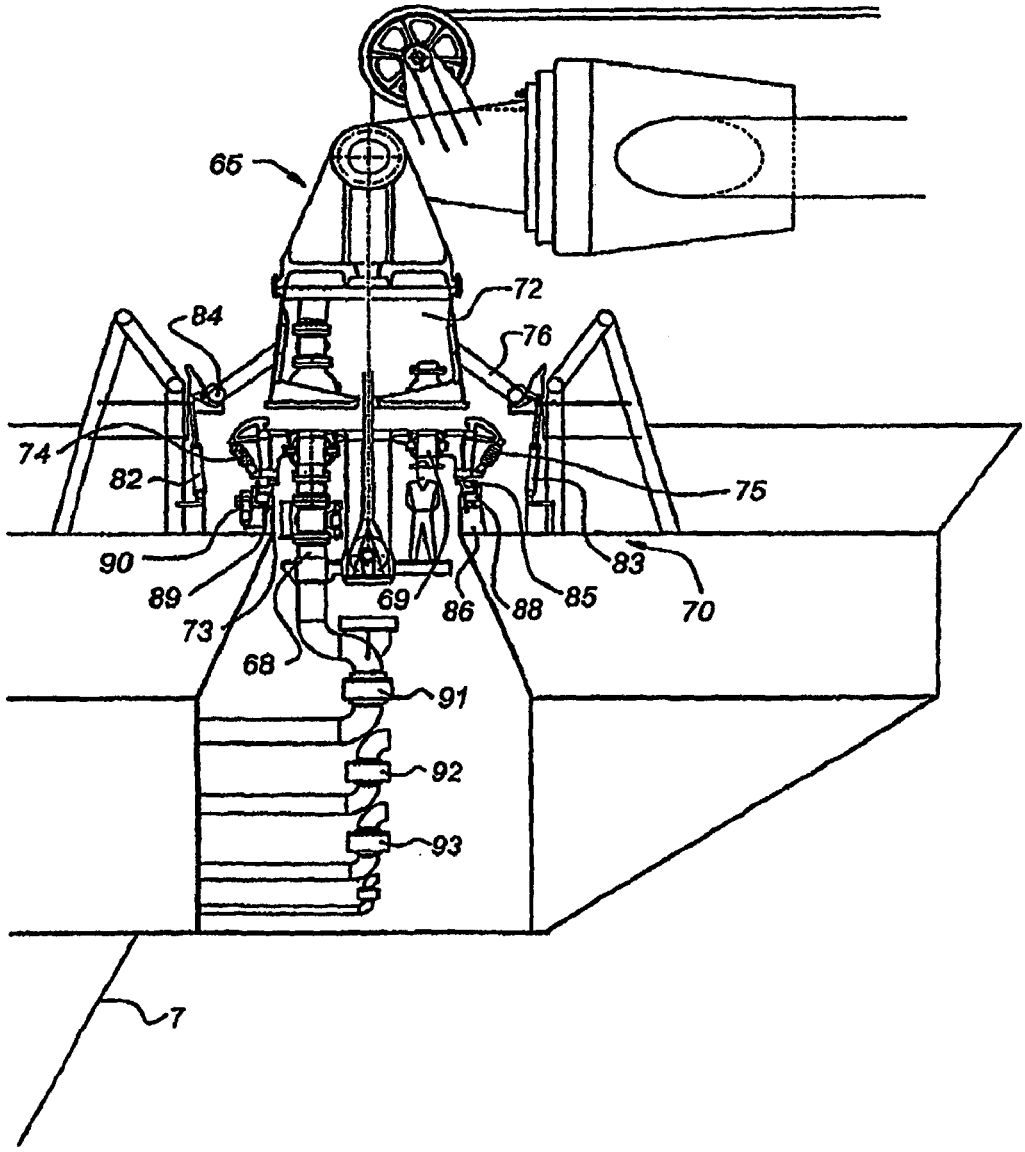
Figure 14:
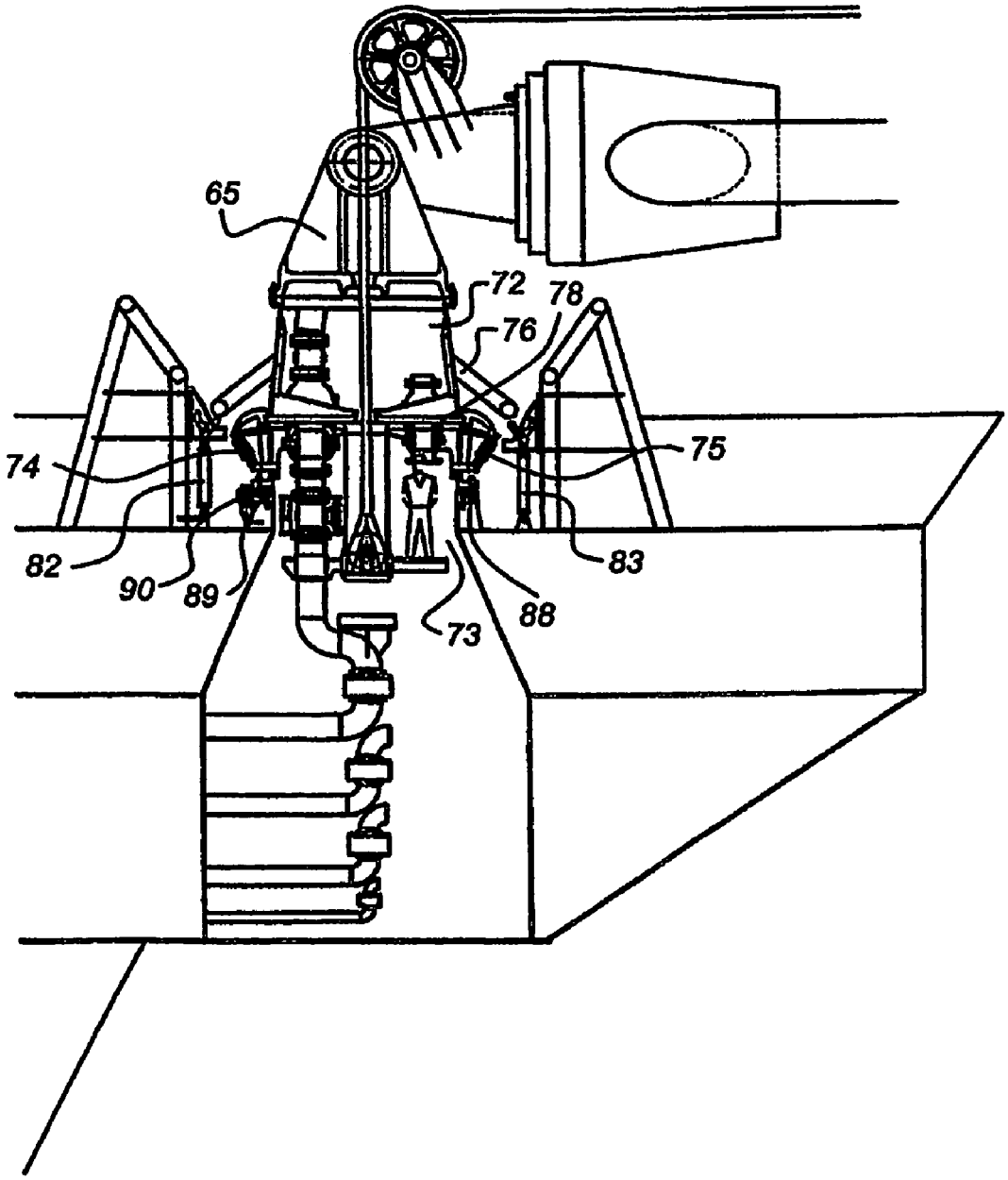
Figure 15:
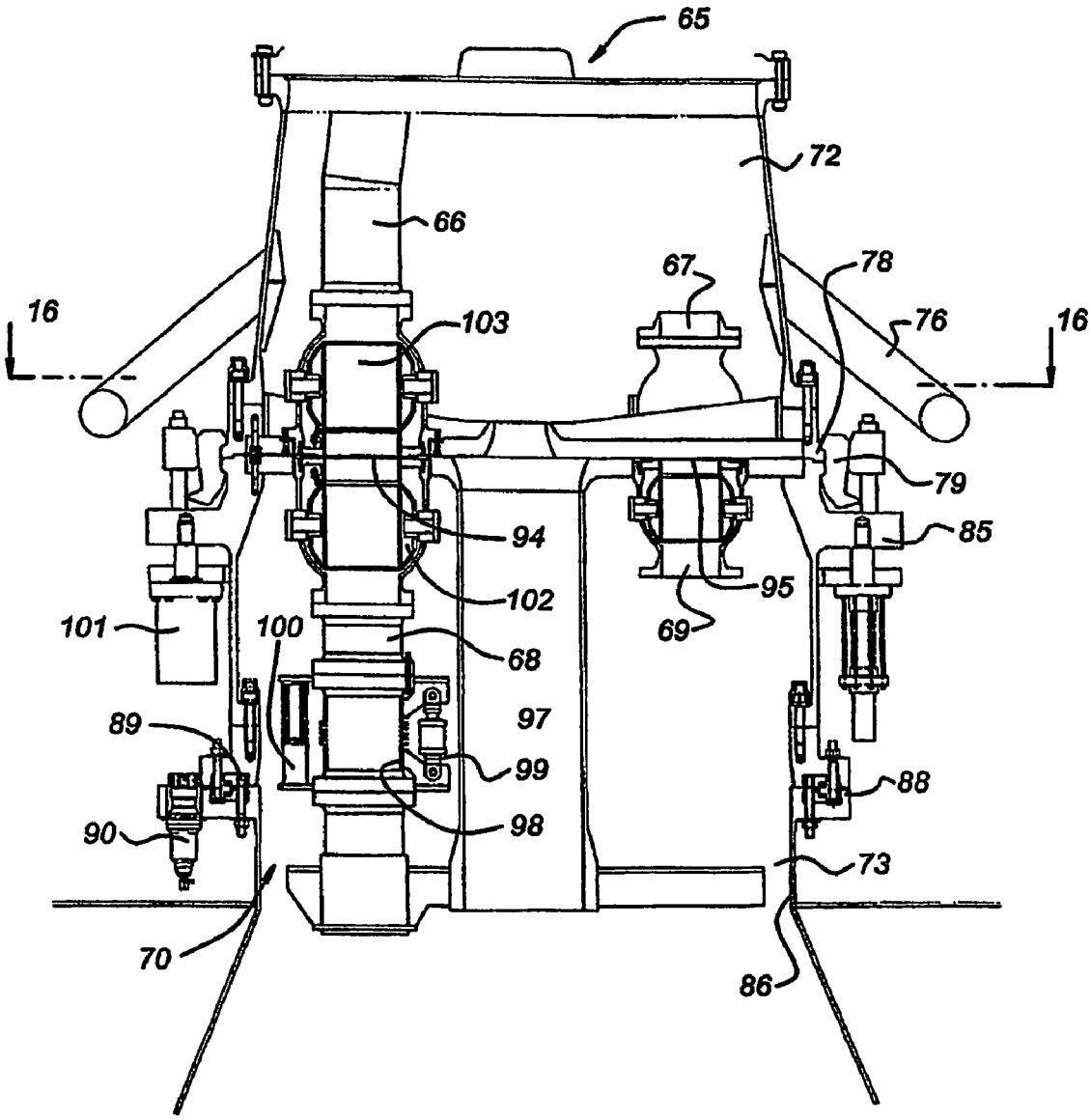
Figure 16:
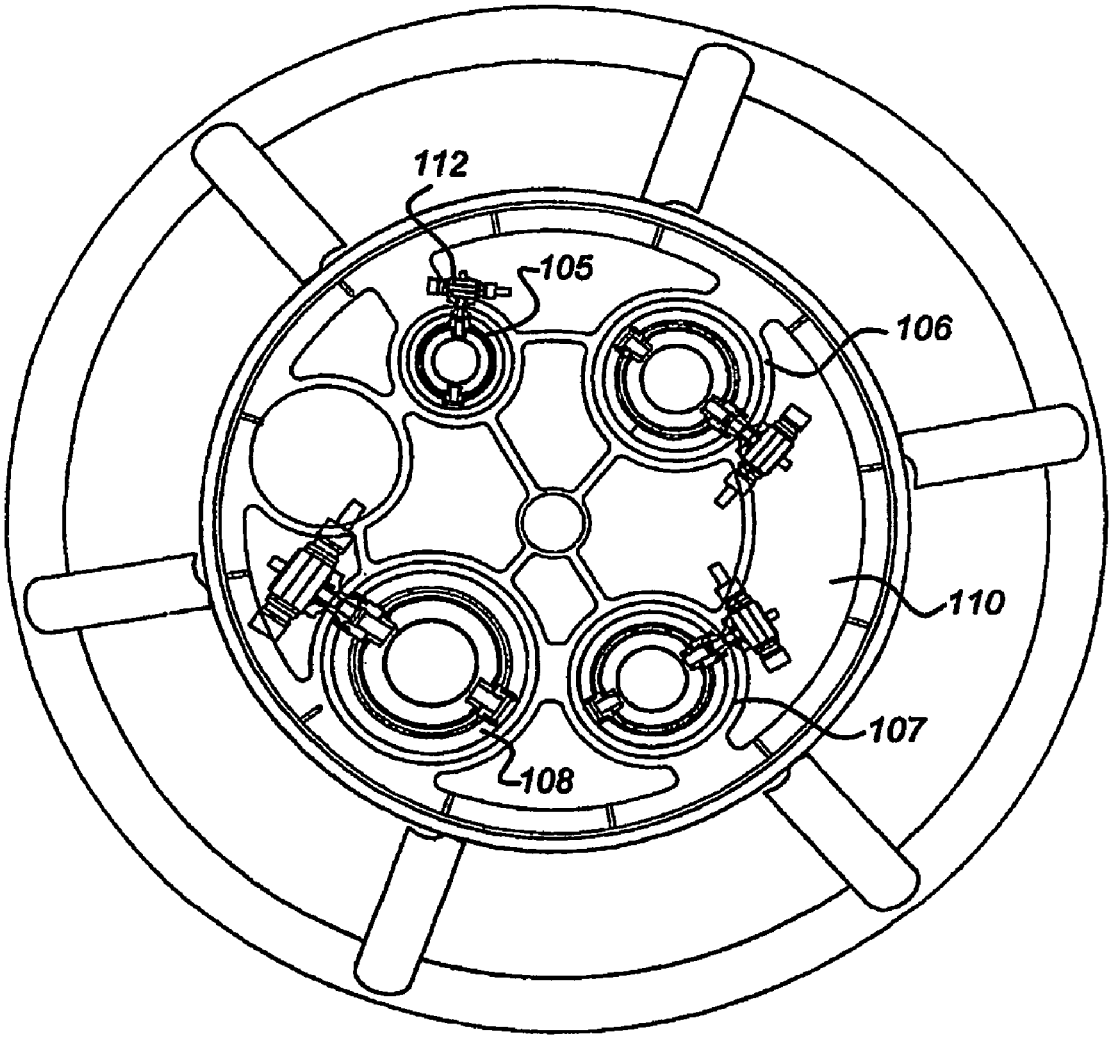
Figure 17:
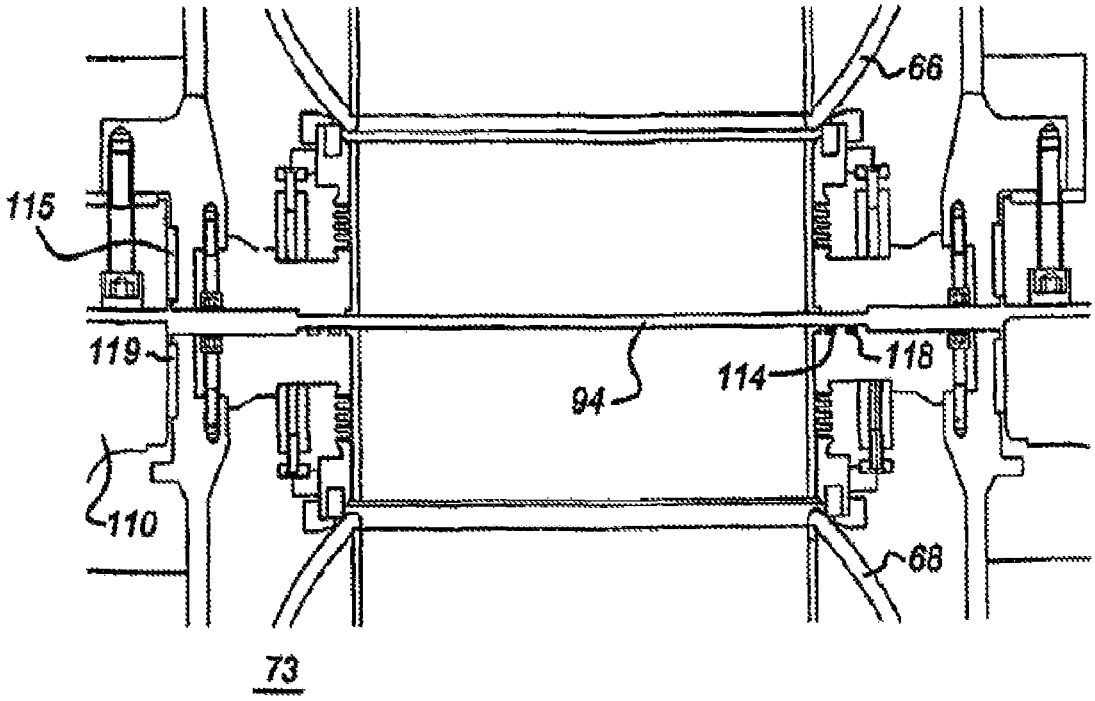
Figure 18:
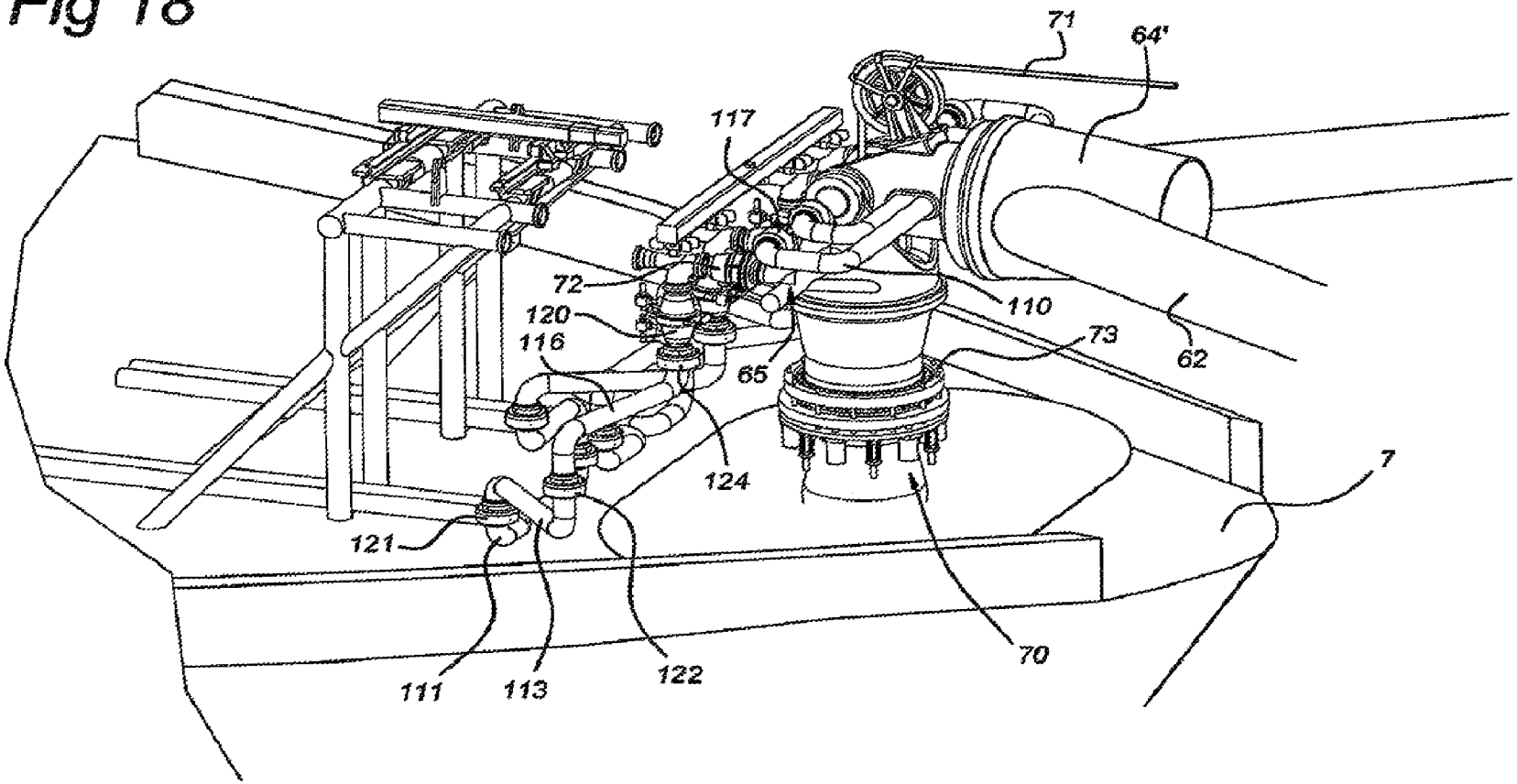
Figure 19:
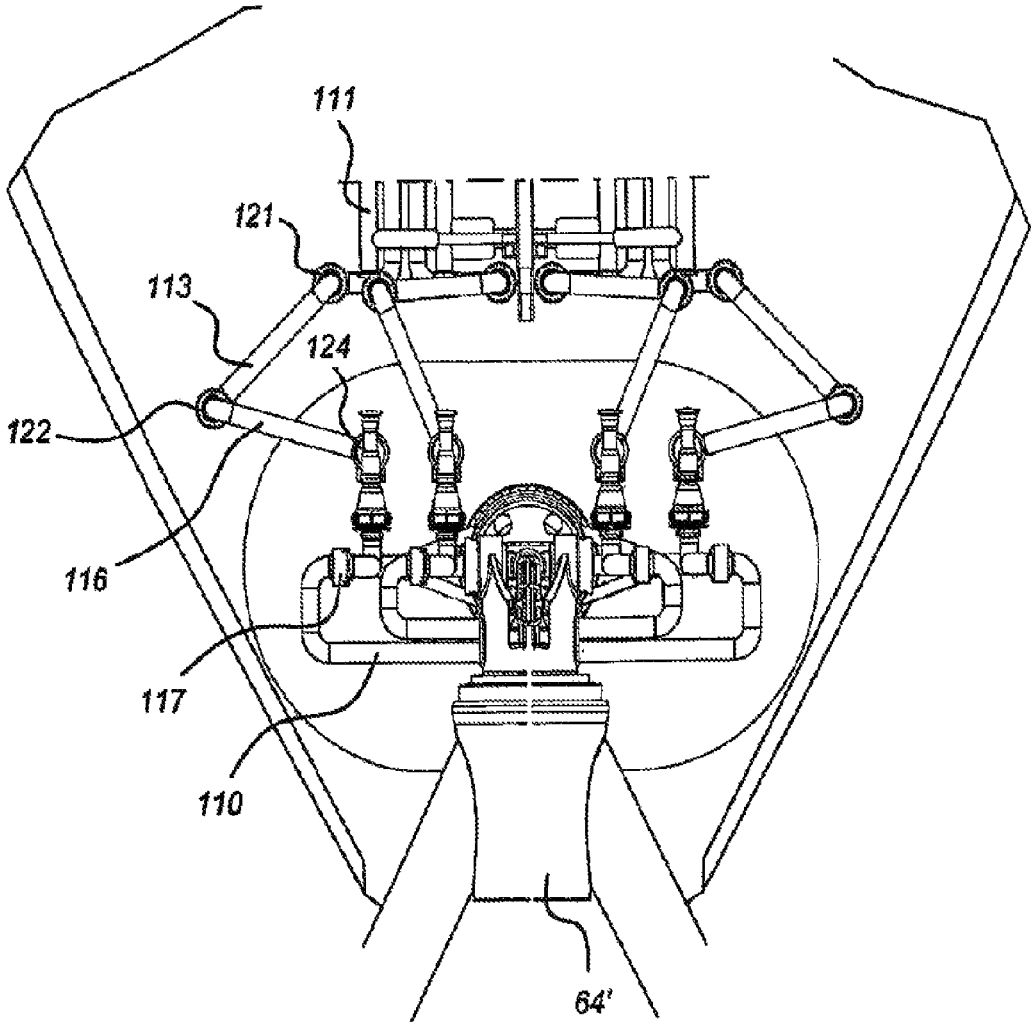

FIG. 13. shows the connector parts being aligned by the retractable grippers;

FIG. 14 shows the connector parts, aligned one above the other and interconnected through clamping means;

FIG. 15. shows a detail of the interconnected connector parts and fluid ducts;

FIG. 16 shows a cross-section along the line 16-16 in FIG. 15;

FIG. 17 shows an enlarged detail of the connected interfaces of the fluid ducts in the first and second connectors, FIG. 18 shows a perspective view of an embodiment with externally placed duct section on the free end of the arm and hinging duct sections on the vessel, and FIG. 19. shows a top view of the embodiment of FIG. 18.

Figure 1:
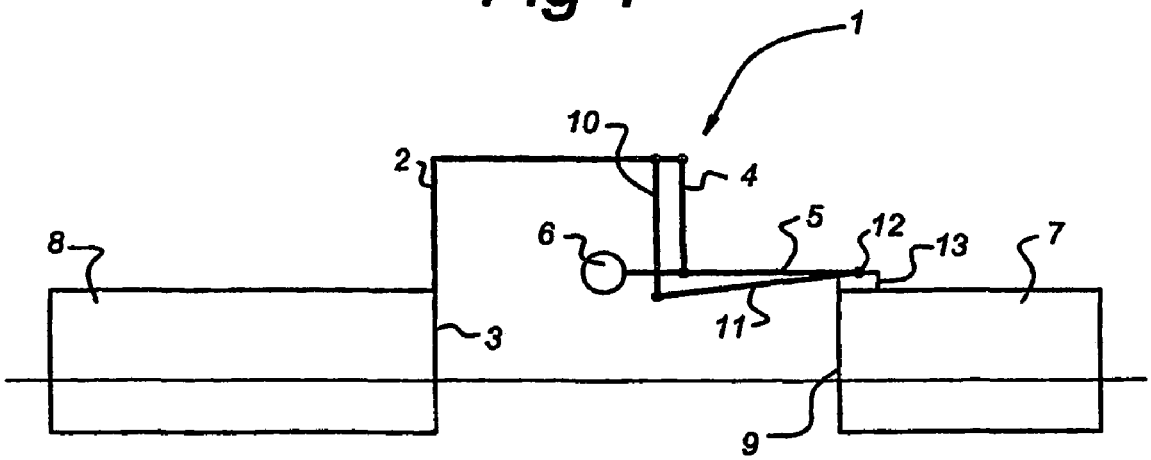
FIG. 1 shows a schematic side view of the cryogenic transfer system for tandem offloading according to the present invention.

FIG. 1 schematically shows the hydrocarbon transfer system 1 of the present invention comprising a support structure 2 placed at the stern 3 of a FPSO barge. From the support structure 2, a first vertical arm 4 is suspended and is connected to a substantially horizontal second arm 5. At a restoring end, a counterweight 6 is connected to the arm 5, which at a coupling end is provided with a mechanical connector 13 for attaching to the bow 9 the LNG-carrier 7. Parallel to the mooring arms 4, 5 cryogenic fluid transfer lines 10, 11 are placed, which are suspended on one side from the support structure 2 and which on the other side are connected in an articulation joint 12 to the mechanical connector 13 of the mooring arm 5. By connecting the flow lines to the mechanical connector, a rapid connection is possible and also a rapid release during emergency situations. However, the transfer line 11 may at its end be connected to the arm 5 instead of to the mechanical connector. The end of transfer line 11 is provided with a fluid connector for connecting to the pipe system of the LNG-carrier 7 after mechanical connection. The dimensions indicated in FIG. 1 are indicative for the order of magnitude of the mooring and transfer system of the present invention by way of illustrative example.

Figure 2:
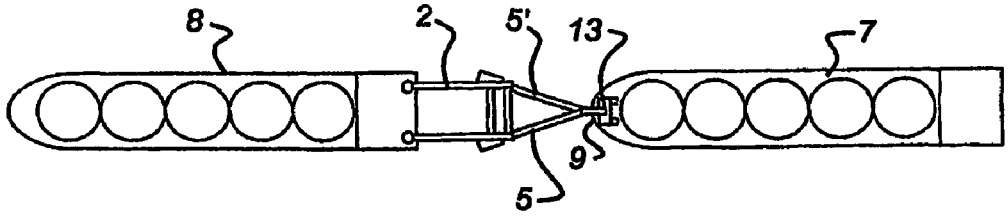
FIG. 2 shows a top view of the transfer system of FIG. 1.
Figure 3:
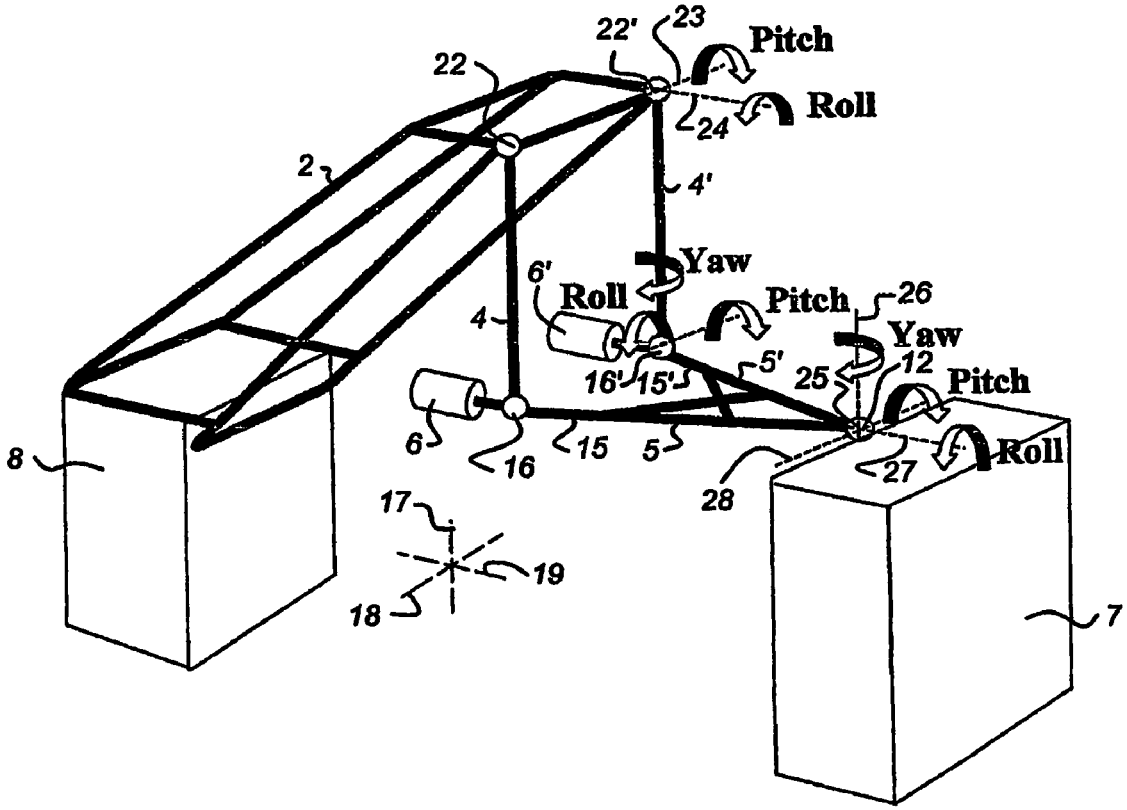
FIG. 3 shows a schematic perspective view of the mooring construction of the present invention.

FIG. 2 shows a top view of the FPSO 8 and LNG-carrier 7, the support structure 2, the horizontal mooring arms 5, 5' and the mechanical connector 13. As can be seen from FIG. 3, the horizontal mooring arms 5, 5' are with their restoring end parts 15, 15' connected to a respective vertical arm 4, 4' via articulation joints 16, 16'. Two counterweights 6, 6' are connected to the restoring end parts 15, 15' of each arm 5, 5'. The articulation joints 16, 16' may for instance comprise three perpendicular circular bearings, or ball-joints allowing rotation around a vertical axis 17 (yaw), a transverse axis 18 (pitch) and a longitudinal axis 19 (roll).

The vertical mooring arms 4, 4' are at their upper ends connected to the support structure 2 in articulation joints 22, 22' allowing rotation of the arms 4, 4' around a transverse axis 23 and a longitudinal axis 24. At the coupling end-part 25, the arms 5, 5' are provided with the mechanical connector 13 allowing rotation around a vertical axis 26 (yaw), a longitudinal axis 27 (roll) and a transverse axis 28 (pitch). The mechanical connector is not shown in detail but may be formed by a construction such as described in U.S. Pat. No. 4,876,978 in the name of the applicant, which is incorporated herein by reference.

Figure 4:
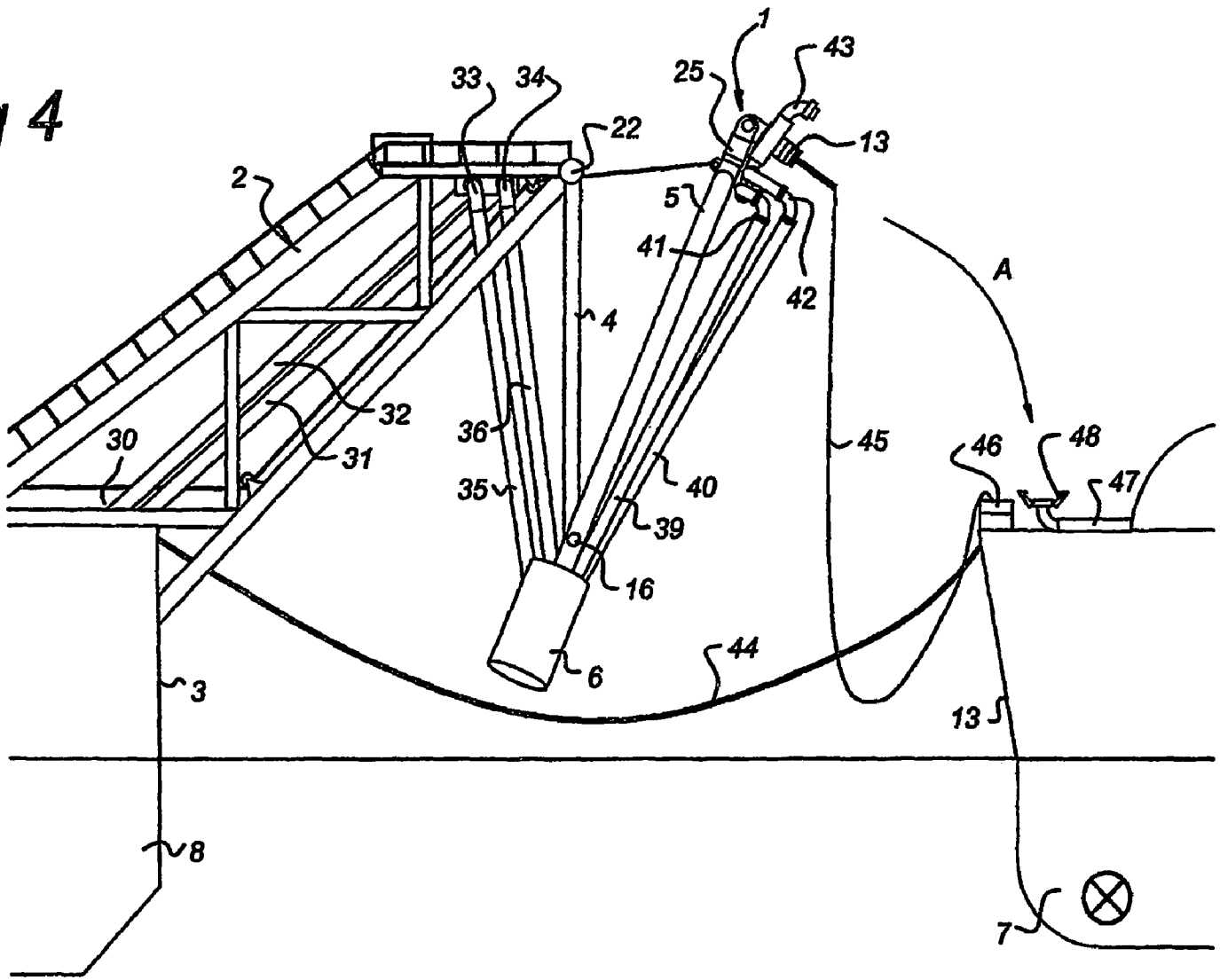
FIG. 4 shows a side view of the mooring arms and transfer pipes prior to coupling of the mechanical and fluid connectors.

FIG. 4 shows the transfer system 1 in which the mooring arms 5 are placed in a substantially vertical position via a cable 30 attached to the coupling end part 25 of the arms 5, 5' and connected with its other end to a winch (not shown) on the FPSO 8. Two rigid pipes 31, 32 extend from the FPSO 8 to a swivel connection 33, 34 on the support structure 2. From the swivel connections 33, 34 two vertical pipes 35, 36 extend downwardly to swivel connections 37, 38 (see FIG. 5). Two horizontal cryogenic transfer pipes 39, 40 extend along the arms 5, 5' to swivel connections 41, 42 on the mechanical connector 13. A fluid connector 43 is provided on the mechanical connector 13.

During connecting of the mooring arms 5, 5' to the bow 9 of the LNG-carrier 7, the vessels are connected via a hawser 44. Via a pilot line 45, the mechanical connector 13 can be lowered and placed into a receiving element 46 on deck of the LNG-carrier 7. By paying out cable 30, the horizontal arm 5 pivots in articulation joints 16, 16' around the transverse axis 18. The vertical ducts 35, 36 can pivot around a transverse axis 23 in articulation joints 33, 34 and in articulation joints 37, 38 as shown in FIG. 5 to assume a substantially vertical position.

Figure 5:
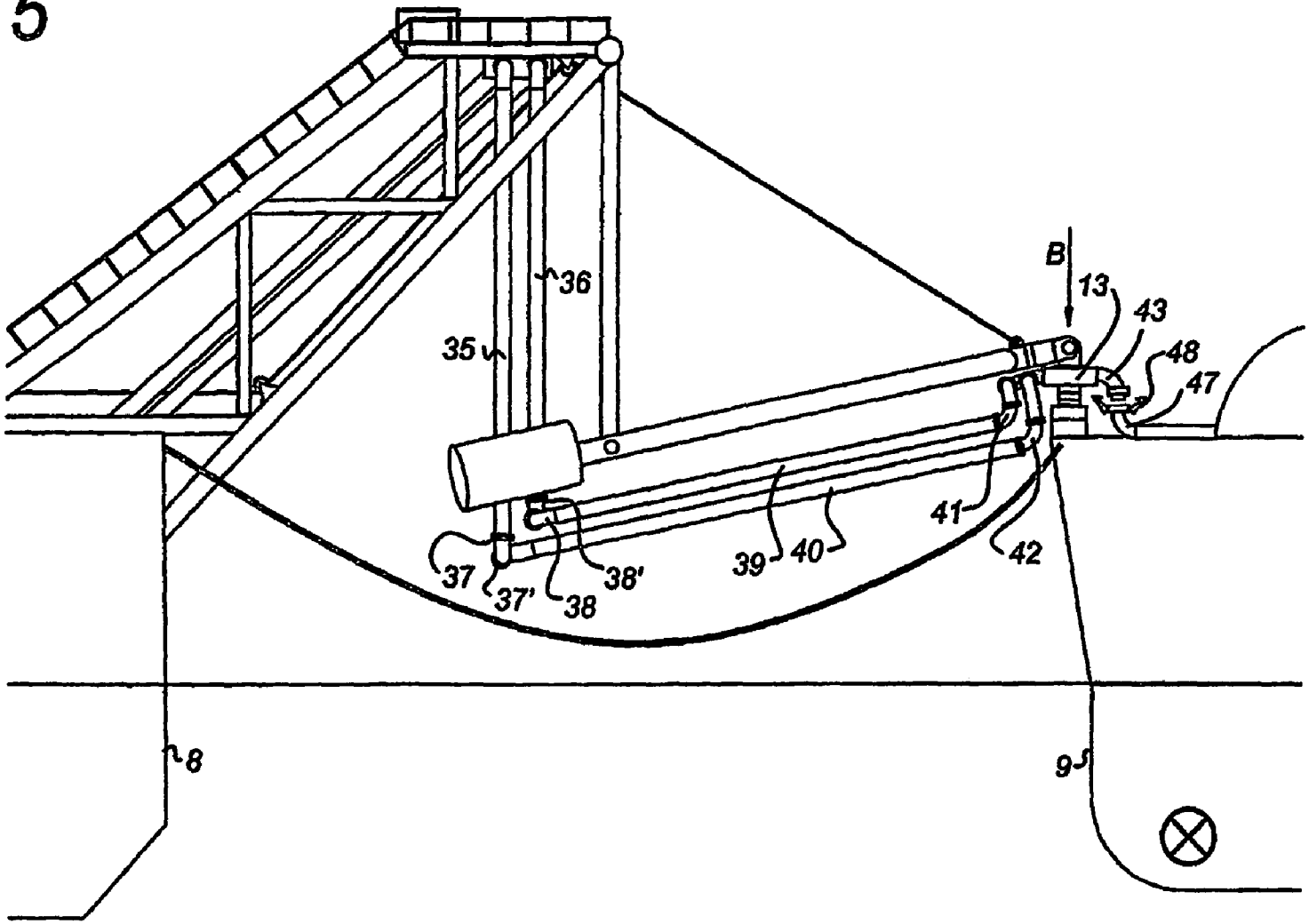
FIG. 5 shows the transfer system of FIG. 4 wherein the mooring arms are attached via the mechanical connector.
Figure 6:
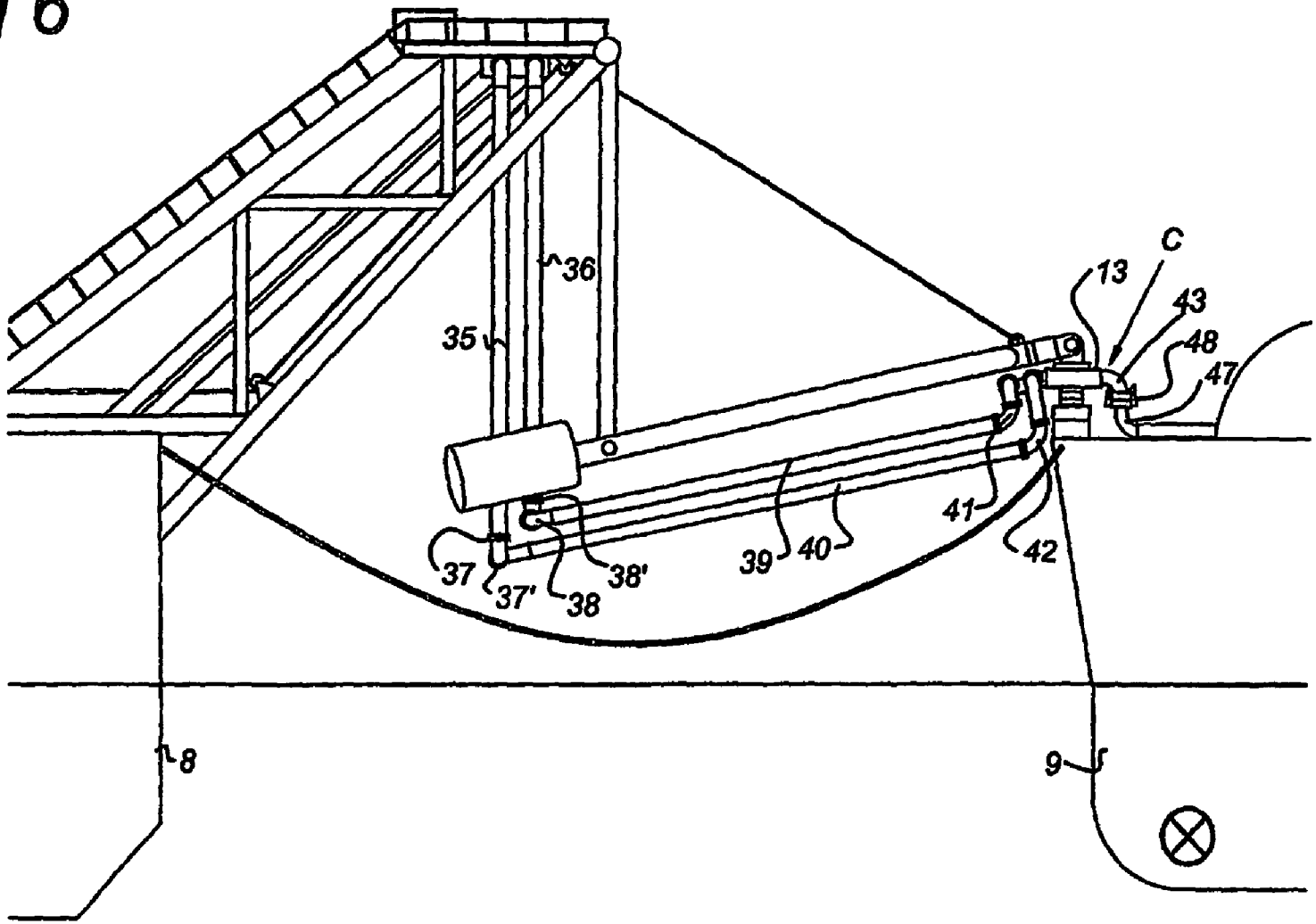
FIG. 6 shows attachment of the fluid connector of the transfer lines.

The horizontal ducts 39, 40 will also pivot around a vertical axis at swivels 37', 38' and a transverse axis a horizontal axis and a vertical arm at the position of two sets of each three perpendicular swivels 41, 42 until the mechanical connector 13 mates with receiving element 46 as shown in FIG. 5. After locking the mechanical connector 13, the fluid connector 43 is attached to piping 47 on deck of the LNG-carrier 7 by raising said piping and engaging clamps 48 such as shown in FIG. 6.

Figure 7:
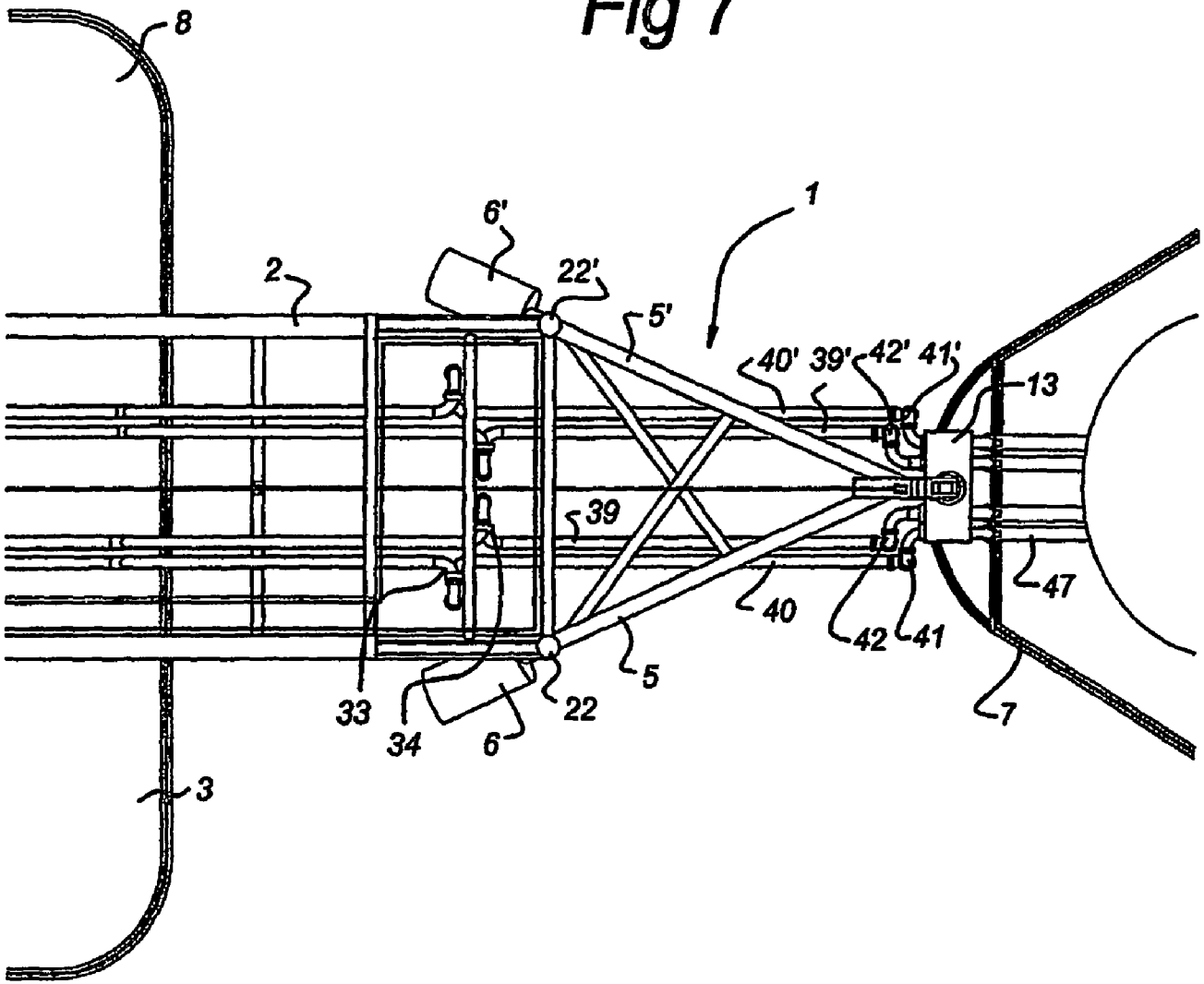
FIG. 7 shows a top view of the transfer system of FIG. 4-6.

FIG. 7 shows a top view of the transfer system 1 in the connected state showing four pipes 39, 39', 40, 40' attached to the mechanical connector 13. The transfer pipes 35, 36 are connected to the support structure 2 in articulation joints 33, 34 and can pivot around a substantially longitudinal axis. The pipes 39, 39', 40, 40' are connected to the mechanical connector 13 in articulation joints 41, 41', 42, 42' and can pivot around a longitudinal, a transverse and a vertical axis. The pipes can move independently of the mooring arms 4, 4', 5, 5'. During yaw-movements of the FPSO 8 or LNG-carrier 7, a good control and sufficient yaw-stiffness is achieved by the arms 5, 5' connected to the counterweights 6, 6'. Yaw displacement (in the horizontal plane) of the LNG-carrier will be counteracted by a restoring moment created by the counterweights 6, 6'. By separating the mooring function and the fluid transfer function, a simplified and proven cryogenic transfer system can be achieved using state of the art components and resulting in reduced and simplified maintenance.

Figure 8:
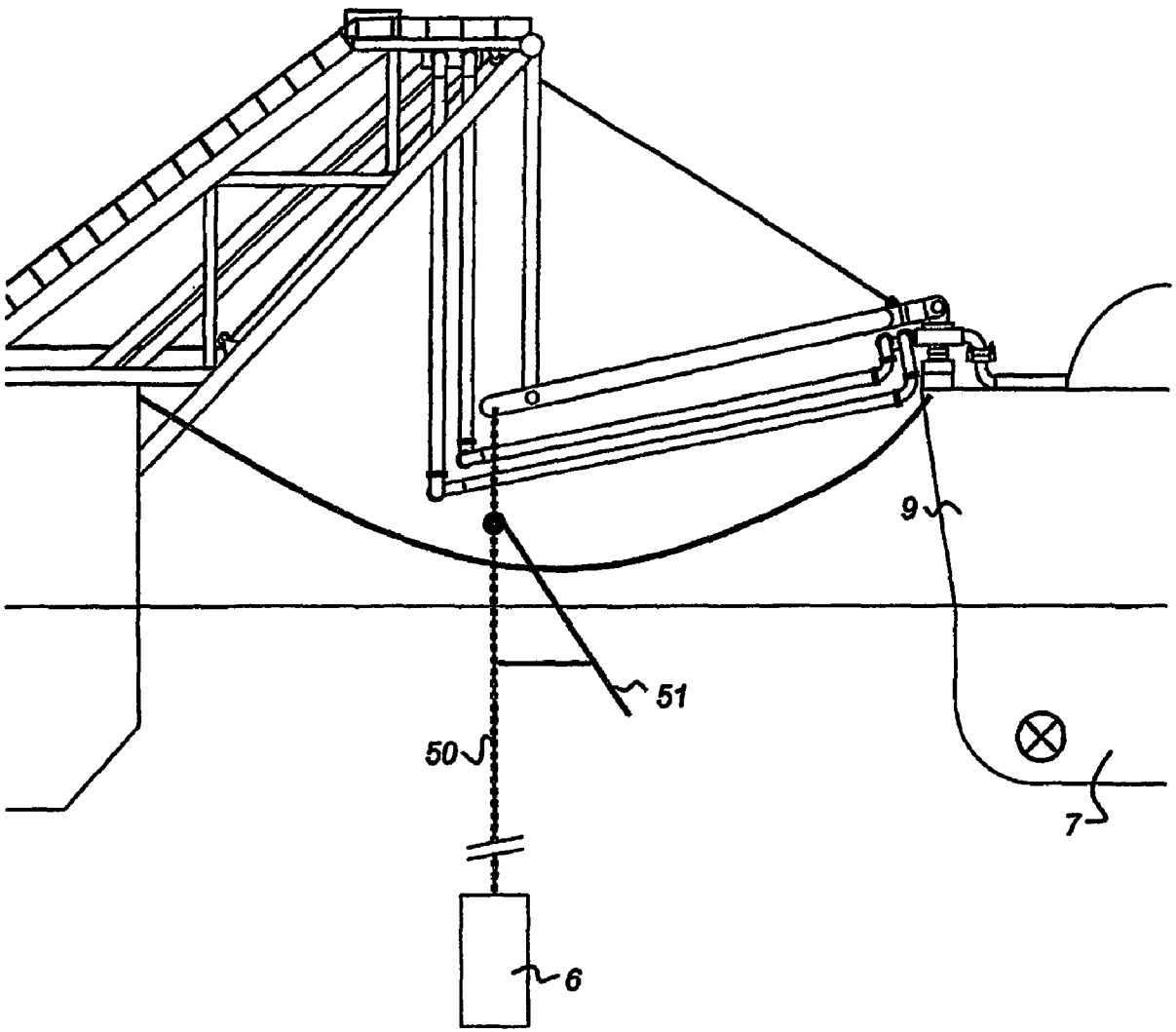
FIG. 8 shows an alternative embodiment of the counterweight of the mooring arms.

As shown in FIG. 8, the counterweights 6 may be suspended from a cable 50 such that movements of the counterweights 6 are damped below water level. A fender 51 may be applied on cable 50 for the counteracting movement of the vessel 7 towards vessel 8 upon lifting of the mooring system 1 to the configuration as shown in FIG. 4. When the bow 9 of the vessel 7 contacts the fender 51, the tension in the chain 50 will exert a restoring force on the vessel.

The fender system described above could be a fender system as described in U.S. Pat. No. 4,817,552 in the name of the applicant. The counterweights 6, 6' can be formed by clump-weights, flushable tanks, buoyancy elements and other constructions generally employed in soft yoke mooring systems. Even though the invention has been described in relation to hard piping 35, 35', 36, 36', 39, 39' and 40, 40' in combination with pipe swivels at articulation joints 33, 34, 41, 42, also flexible hoses or combinations of flexible hoses and hard piping, and ball-joints instead of pipe swivels can be employed. An example of a ball-joint suitable for cryogenic fluid transfer has been described in WO00/39496, which is incorporated herein by reference.

Figure 9:
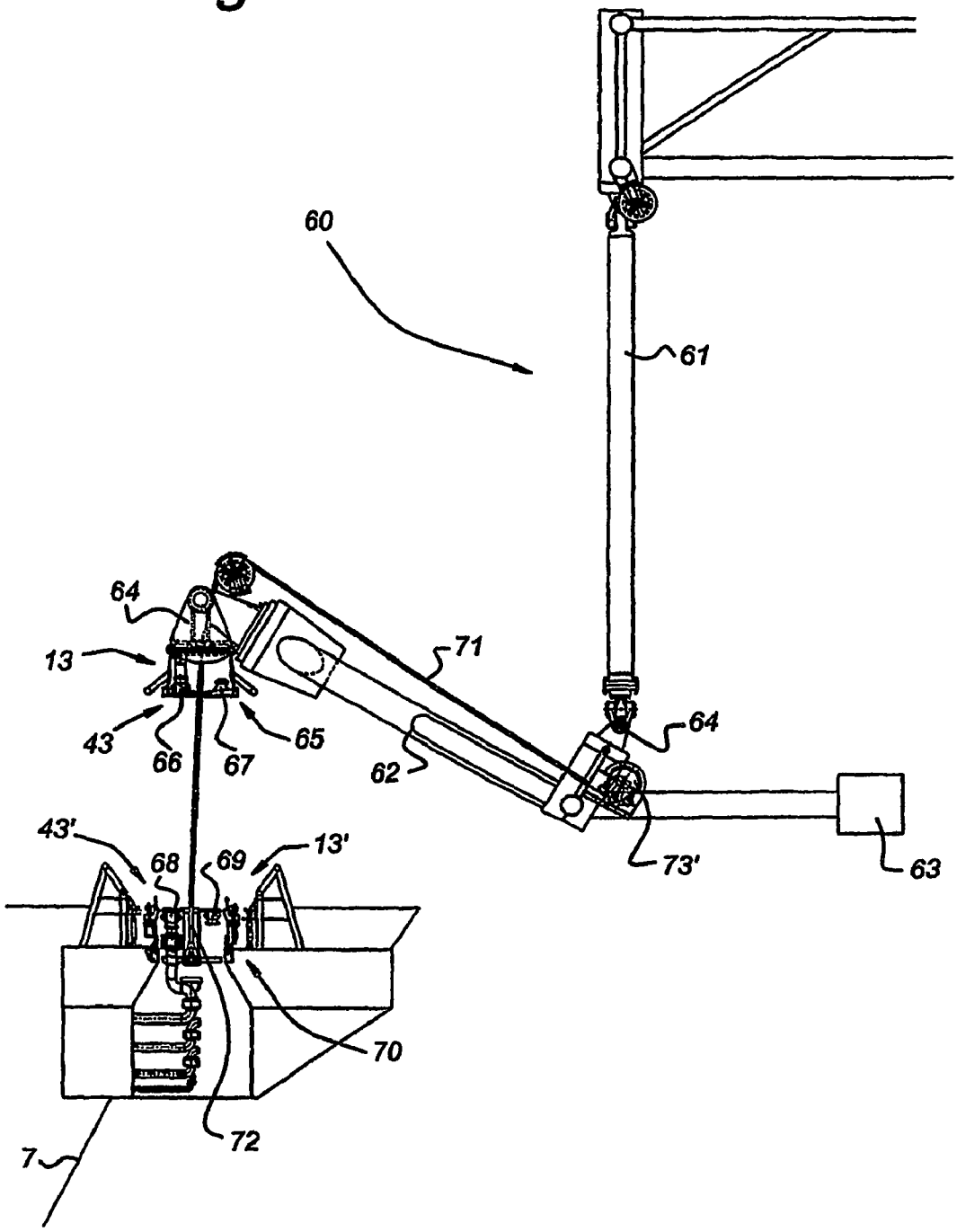
FIG. 9 shows a detail of the connector parts of a transfer system according to the present invention in the disconnected stage.

FIG. 9 shows the connectors of a hydrocarbon transfer system 60 according to the present invention, an articulated arm 61, 62. The structure can be a platform, a semi submersible structure, an offshore tower or arm or an onshore loading/offloading terminal. The arm 62 is supported in a substantially horizontal position in a hinge point 64 from vertical arm 61 and is balanced by a counterweight 63. At the free end 64, the arm 62 carries a first connector part 65 of mechanical connector 13, 13'. Within the arms 61, 62, or supported externally on the arms 61, 62, such as shown in FIGS. 4-8, hydrocarbon fluid ducts 66, 67, for instance LNG ducts and vapour return ducts, are situated. The ducts 66, 67 can be attached to fluid transfer ducts 68, 69 in second connector part 70 of fluid connector 43, 43'. The first connector part 65 can be lowered onto the second connector part 70 on the vessel 7 via a cable 71 which extends through a central space 72' of connector part 70 and through the connector part 65 at the end of arm 62, to a winch 73' on the arm 62.

Figure 10:
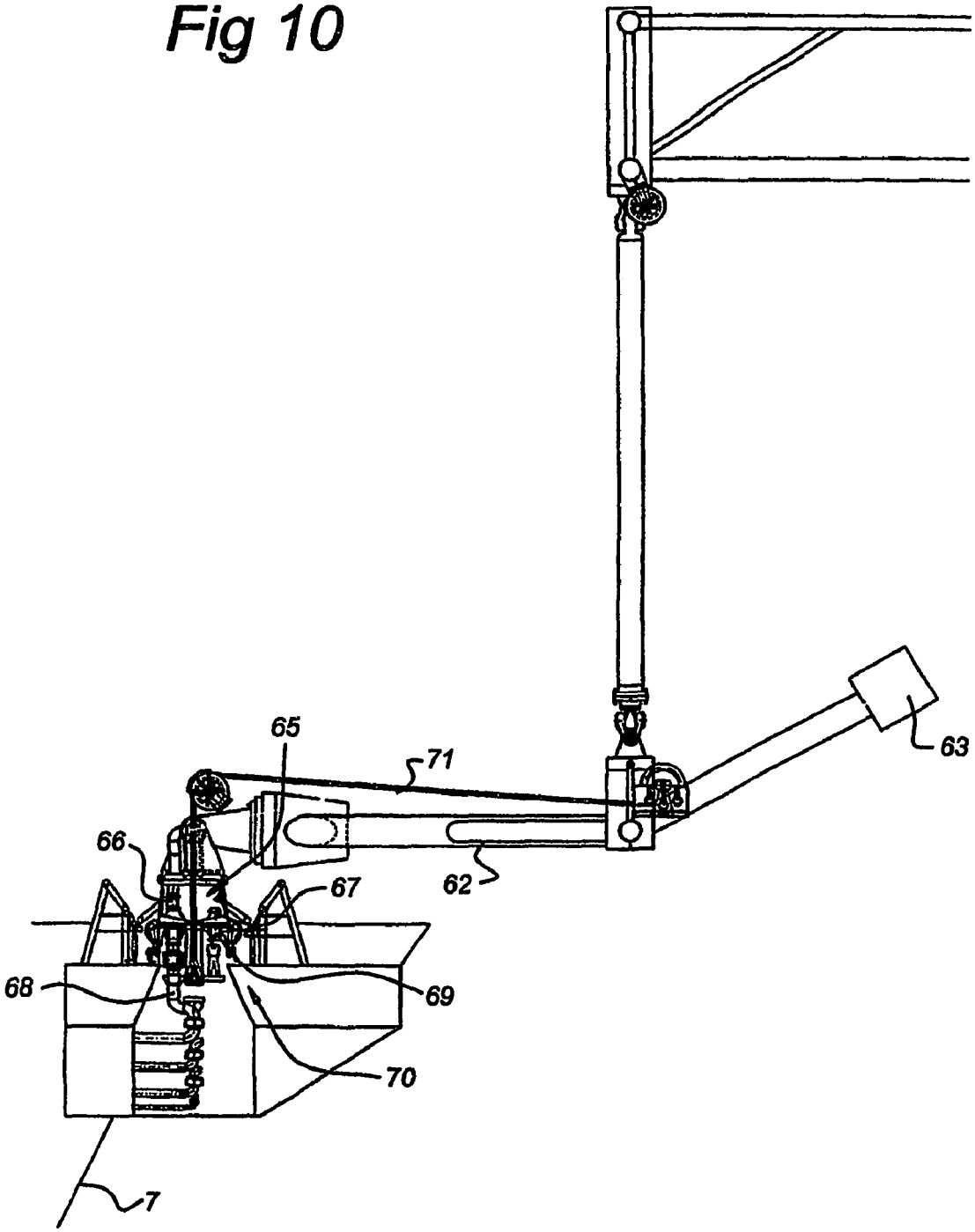
FIG. 10 shows the connector parts of FIG. 9 in the connected situation.

As can be seen from FIG. 10, by tightening the cable 71, the first connector part 65 and second connector part 70 can be engaged and locked in position, and fluid connection between fluid transfer ducts 66, 68, 67, 69 is established.

Figure 11:
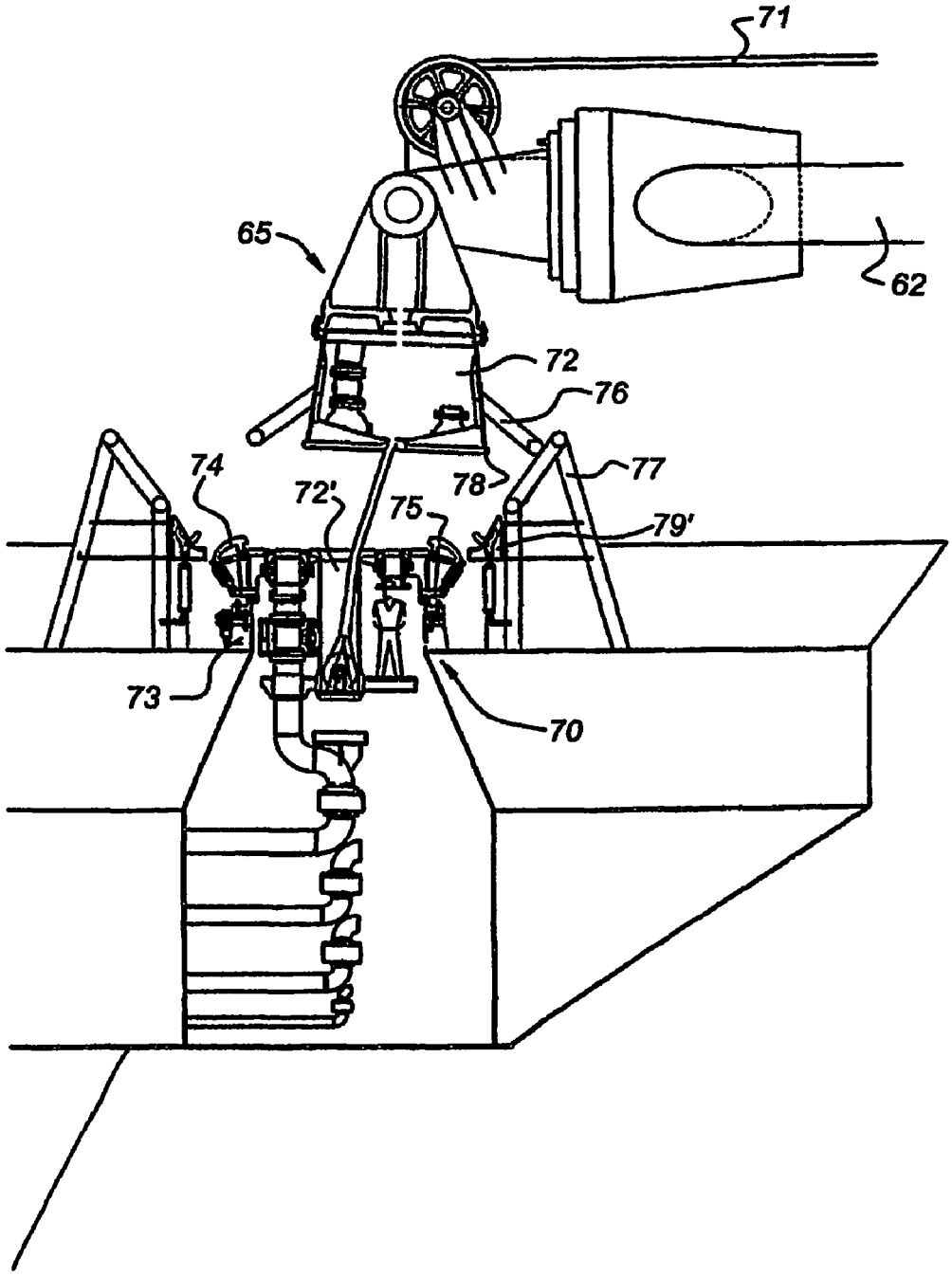
FIG. 11 shows a detail of the connector parts of FIG. 9, the connector parts at the end of the arm approaching the connector parts on the vessel.

In FIG. 11 it is shown how the housing 72 of first connector part 65 is provided with a sideways flange or fender 76 for positioning of the first connector part 65 with respect to a fender 77 placed around and above second connector part 70. By lowering the arm 62, the connector part 65 is guided by the downwardly sloping part of the fender 77 to the second connector part 70 by tightening of the cable 71, to an approximate coupling projection.

Figure 12:
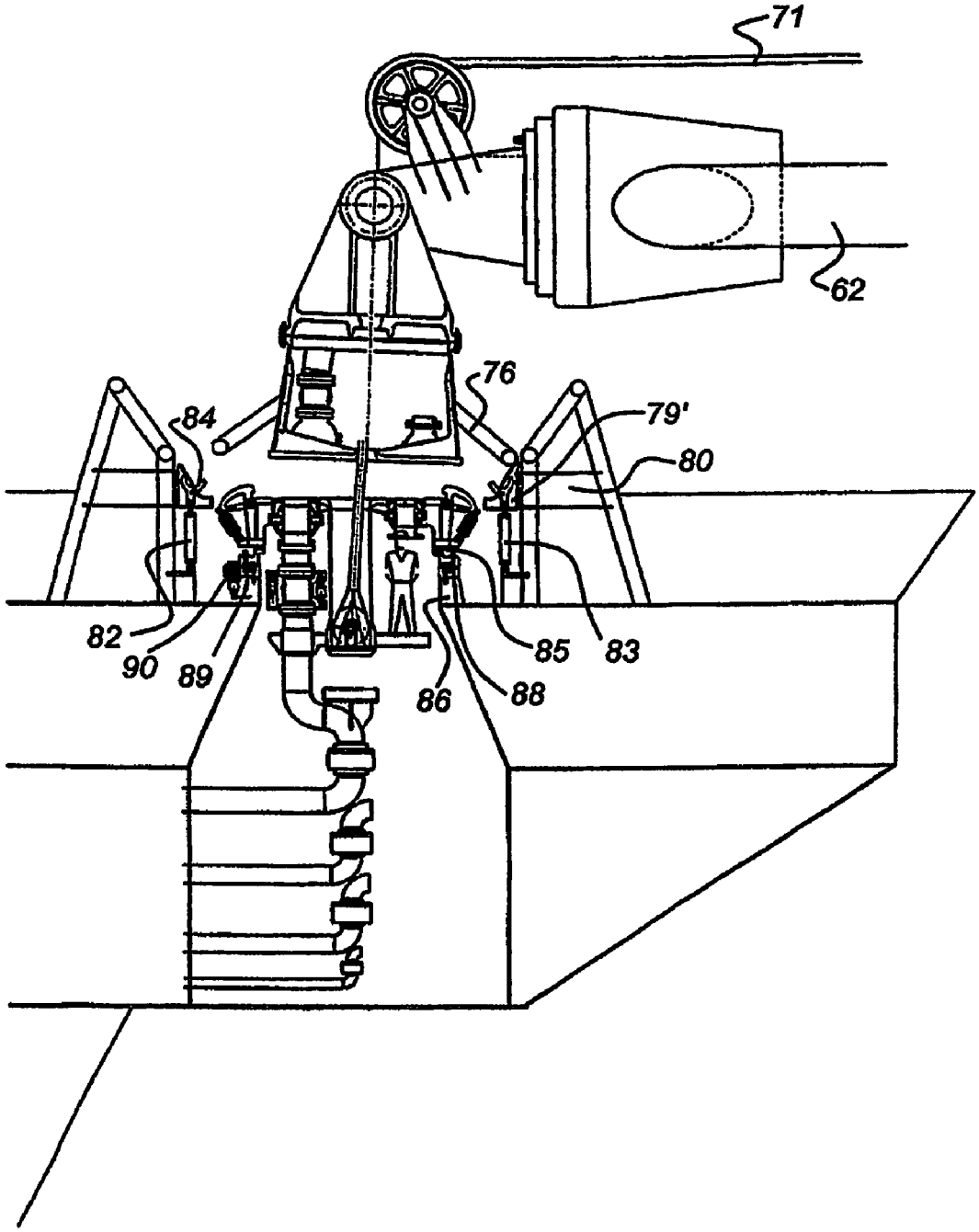
FIG. 12 shows the connector parts prior to engagement of retractable grippers.

As is shown in FIG. 12, the fender 76 is contacted by a guiding surface 79, which is mounted on a frame 80. By sliding down the guiding surface 79', the fender 76 can be engaged with hydraulic grippers 82, 83, as shown in FIG. 13. The grippers 82, 83 comprise a hydraulic cylinder and rotatable clamping head 84 that, when placed in the position shown in FIG. 13, clampingly engages with fender 76.

As shown in FIG. 14, the housing 72 of first connector part 65 and housing 73 of second connector part 70 are placed one on top of the other, in an aligned position, whereafter the grippers 82, 83 are released and the locking member 74, 75 are engaged with circumferential rim 78 on housing 72. Prior to or after attaching the locking member 74, 75, in the situation shown in FIG. 13, the upper part 85 of housing 73 of second connector part 70 can be rotated around a centreline relative to a support part 86 via bearings 88, 89. Rotation is imparted by a drive motor 90, which may rotate the upper part 85 through a small angle or through 360° when required. Rotational sections of the ducts interconnected via first and second connector parts 65, 70 are placed within the vessel 7 below second connector part 70 as shown in FIGS. 11, 12 and 13 for swivels 91, 92 and 93.

As can be seen in FIG. 15, the housing 72 of upper connector part 65 is attached to housing 73 of second connector part 70 through a collet ring 79 locking on the circumferential rim 78 on housings 72, 73. After mechanical interconnection of housings 72, 73, or simultaneous therewith, the sealing faces 94, 95 of fluid ducts 66-69 are engaged. The ducts 68, 69 in the lower connector part 70 each comprise displacement members 97 in the form of a deformable bellow wall part 98, a hydraulic jack 99 and a spring 100. During the connection phase, the bellows 98 are retracted by the hydraulic jack 99 attached adjacent to the bellow by a few mm to a few cm below the plane of interconnection of housings 72, 73. Retraction of the hydraulic jack 99 compresses spring 100 such that the sealing face 94 is retracted below the contacting surface of lower connector part 73. After connection of the collet ring 79, by actuation of hydraulic jacks 101, the jack 97 is depressurised such that spring 100 will push the upper part of fluid duct 68 upwards against the sealing face 94, 95 of upper fluid ducts 66, 67. After connection of fluid ducts 66, 68, both fluid duct sections 66, 68 will be able to rotate together upon rotation of rotating part 85 of lower connector part 73 on bearings 88, 89 and upon rotation of the upper duct section of duct 68 relative to stationary piping on the vessel 7 via swivel 91.

Each duct 66, 68 comprises ball valves 102, 103 which are closed prior to connecting duct sections 66, 68 and which are opened after fluid tight connection of the sealing faces 94, 95. The ball valves 102, 103 are situated near the end sections of the ducts, such that small gas volumes are present above the valves, such that safe disconnecting can take place without a risk of large volumes of gas being set free.

As shown in FIG. 16, four ducts 105, 106, 107, 108, such as product fluid line (LNG), a vapour return duct, a warning gas duct, displacement gas duct, and a back up duct, are comprised in a support frame 110. Ball valves 105-108 are each opened and closed by a respective valve actuating unit 112.

FIG. 17 shows the sealing face 94 of upper duct 66 and lower duct 68 comprising angular seals 118, 114 and a slide bearing 115, 119. The slide bearings 115, 119 have a dual function as they isolate the fluid path of ducts 66, 68 from the other parts of the connector and they function as slide bearings for allowing relative movement of the lower duct 68 with respect to supporting frame 110. The slide bearings 115, 119 can for instance be made of PTFE.

FIG. 18 and FIG. 19 show an embodiment according to the present invention in which the free end 64' of the arm 62 comprises a J-shaped duct 110. Product piping 111 on the vessel 7 comprises an articulated end with horizontal ducts 113, 116, which are rotatable in the horizontal plane around swivels 121, 122, 124. Upon connecting the coupling members 72, 73, the ducts 113, 116 are be hinged out of the coupling area until a mechanical connection has been established and the vessel 7 is securely moored to the structure 8 via the arm 62. Thereafter, the ducts 113, 116 are hinged into their appropriate coupling positions, whereafter the duct section 120 can be extended to bridge the vertical distance to the J-shaped duct 110 that is carried on the free end 64' of the arm 62. The swivel 117 at the end of the J-shaped duct 110 has a substantially horizontal axis of rotation and takes up heave movements of the vessel 7 relative to the arm 62.

The invention claimed is:

1. A hydrocarbon transfer system comprising:

a first structure carrying a vertical arm from which a balanced arm is suspended in an articulation point, said balanced arm in a connected state extends substantially in a horizontal direction between a vessel and said first structure, said balanced arm having at a free end a first connector part, the vessel comprising a second connector part, wherein each said first and second connector part comprises a housing with an outer surface, the housing of the first connector part supporting at least two fluid ducts on an exterior thereof, said at least two fluid ducts are symmetrically arranged on each side of a longitudinal center line of the balanced arm, said at least two fluid ducts each having a fluid duct free end and are configured to be placed with a respective said fluid duct free end into sealing engagement with corresponding fluid ducts on the vessel, in a releasable manner upon coupling and uncoupling, along respective sealing faces situated at an exterior position relative to the outer surface of each said housing, and a locking member for locking together the housing of each said first and second connector part, for forming a mechanical connection between the vessel and the first structure, wherein the fluid ducts on the vessel each comprises a substantially horizontally directed first and second duct section, the first duct section being with a first swivel with a substantially vertical axis of rotation, connected to piping on the vessel in a position that is situated on a side of the connector parts that is opposite to a side of the balanced arm at a relatively large distance from the first and second connector parts, the second duct section being with a second swivel having a substantially vertical axis of rotation, connected to the corresponding fluid duct on the housing of the first connector part, the first duct section and the second duct section are mutually connected via a third swivel having a substantially vertical axis of rotation, wherein the second duct sections in use bridge a coupling area between the first swivel and the connector parts, said coupling area being an entire perimeter beneath said at least two fluid ducts of said first connector part extending to a deck of the vessel, and wherein the second duct sections during coupling and uncoupling of the connector parts are configured to be hinged out of the coupling area.

2. The hydrocarbon transfer system according to claim 1, wherein the fluid ducts on the vessel and/or the at least one fluid duct on the housing of first connector part comprises a section which is displaceable in the axial direction by a displacement member for varying the axial position of the sealing faces of the movable duct sections relative to the housing.

3. The hydrocarbon transfer system according to claim 1, wherein two J-shaped ducts extend in diametrically opposed directions from the housing of the first connector part, each J-shaped duct carrying at its free end a fourth fluid swivel having a substantial horizontal axis of rotation.

4. The hydrocarbon transfer system according to claim 2, wherein two J-shaped ducts extend in diametrically opposed directions from the housing of the first connector part, each J-shaped duct carrying at its free end a fourth fluid swivel having a substantial horizontal axis of rotation.

5. The hydrocarbon transfer system according to claim 1, which is adapted to establish a stable mooring of the vessel to the structure by connecting said first connector part on said balanced arm to said second connector part on the vessel prior to connecting the fluid duct on the vessel to the at least one fluid duct on the housing of the first connector part.

6. The hydrocarbon transfer system according to claim 1, which is adapted to transfer mooring forces to said vertical arm and to resist one or more movements of yaw, roll and pitch.

* * * * *